US007631400B2

(12) United States Patent
Chiang

(10) Patent No.: US 7,631,400 B2
(45) Date of Patent: Dec. 15, 2009

(54) BUCKLE FOR SWIMMING GOGGLES

(76) Inventor: Herman Chiang, 11F-2, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 335 days.

(21) Appl. No.: 11/418,011

(22) Filed: May 5, 2006

(65) Prior Publication Data

US 2007/0256283 A1 Nov. 8, 2007

(51) Int. Cl.
*A44B 11/12* (2006.01)
*A61F 9/02* (2006.01)

(52) U.S. Cl. ..... 24/170; 24/191; 24/193; 2/426; 2/450

(58) Field of Classification Search ..... 2/426, 2/428, 430, 440, 441, 443, 448–450; 24/163 R, 24/170, 191, 193, 265 R, 265 BC
See application file for complete search history.

(56) References Cited

U.S. PATENT DOCUMENTS 6,715,449 B1 * 4/2004 Jordan ..... 119/863
6,832,394 B1 * 12/2004 Chiang ..... 2/428
6,961,965 B2 * 11/2005 Chiang ..... 2/445
7,007,311 B2 * 3/2006 Chiang ..... 2/448
7,020,904 B2 * 4/2006 Chiang ..... 2/442
7,055,182 B2 * 6/2006 Chiang ..... 2/450
7,146,653 B2 * 12/2006 Chou ..... 2/426
7,185,373 B2 * 3/2007 Chiang ..... 2/445
7,257,848 B2 * 8/2007 Chiang ..... 2/448
2006/0032027 A1 * 2/2006 Shiue ..... 24/191
2006/0096068 A1 * 5/2006 Dingel ..... 24/163 R

* cited by examiner

*Primary Examiner*—Robert J Sandy
(74) *Attorney, Agent, or Firm*—Cheng-Ju Chang

(57) ABSTRACT

A buckle for swimming goggles is assembled on a left/right frame of swimming goggles, allowing a head strap pulling therethrough and controlling engagement with or disengagement from stopping grooves of the head strap. The buckle for swimming goggles includes a connecting base, a pressing member pivoting to the connecting base by means of leverage, a button for controlling the pressing member to disengage from the stopping grooves of the head strap, a cover assembled to the connecting base, a wrapping layer, and a mounting element between the connecting base and the cover for mounting on the left/right frame of the swimming goggles. The wrapping layer is provided on an outward side of the cover, and enveloping the button entirely, thereby avoiding nipping users' hair.

11 Claims, 5 Drawing Sheets

BUCKLE FOR SWIMMING GOGGLES

BACKGROUND OF THE INVENTION

1. Field of the Invention

The present invention relates to a buckle for swimming goggles, and particularly to a buckle for swimming goggles, which allows to adjust a head strap directly without the need of taking the swimming goggles down and do not nip users' hair when the swimming goggles are worn.

2. Related Art

Buckles are popularly used to adjust head straps of swimming goggles. Ordinarily, the head straps are drawn along guiding holes in the buckles. The swimming goggles have to be taken down before the head straps are adjusted. To solve this problem, TW Utility patent application Nos. 91220914, 92216640, 93208471, 9421182, and U.S. patent Ser. Nos. 09/034,907, 10/420,850, 10/873,260, and etc. put forward some solutions. Generally speaking, in these solutions, buckles for swimming goggles are pressed to allow a head strap to be adjusted without taking down swimming goggles. The buckles commonly have pressing plates pivoting to the swimming goggles according to leverage principle. A first end of a pressing plate abuts against stopping grooves of the head strap. In the event that a second end of the pressing plate is pressed, the first end of the pressing plate disengages from the head strap, allowing the head strap to be adjusted.

However, the buckles in prior art are exposed out of manual portions of the swimming goggles, and tend to nip users' hair when the swimming goggles are worn.

SUMMARY OF THE INVENTION

Accordingly, an object of the present invention is to provide a buckle for swimming goggles, which allows a head strap to be adjusted easily without taking down the swimming goggles, and prevents from nipping users' hair simultaneously.

The buckle for swimming goggles comprises a connecting base, a pressing member, a button, a cover, a wrapping layer and a mounting element. The connecting base defines a slot for allowing a head strap movable therethrough. The pressing member pivots to the connecting base by means of leverage. The pressing member has a biasing wall integrally formed on an end thereof for abutting against stopping grooves of the head strap, and a free end opposite to the biasing wall. The button controls the pressing member to disengage from the stopping grooves of the head strap. The cover is assembled to the connecting base. The wrapping layer is provided on an outward side of the cover, and envelops the button. The mounting element is formed between the connecting base and the cover for mounting on the left/right frame of the swimming goggles.

The wrapping layer is integrally formed with the cover, alternatively the wrapping layer is separately formed and locks with the cover.

DESCRIPTION OF THE PREFERRED EMBODIMENTS

Figure 1:
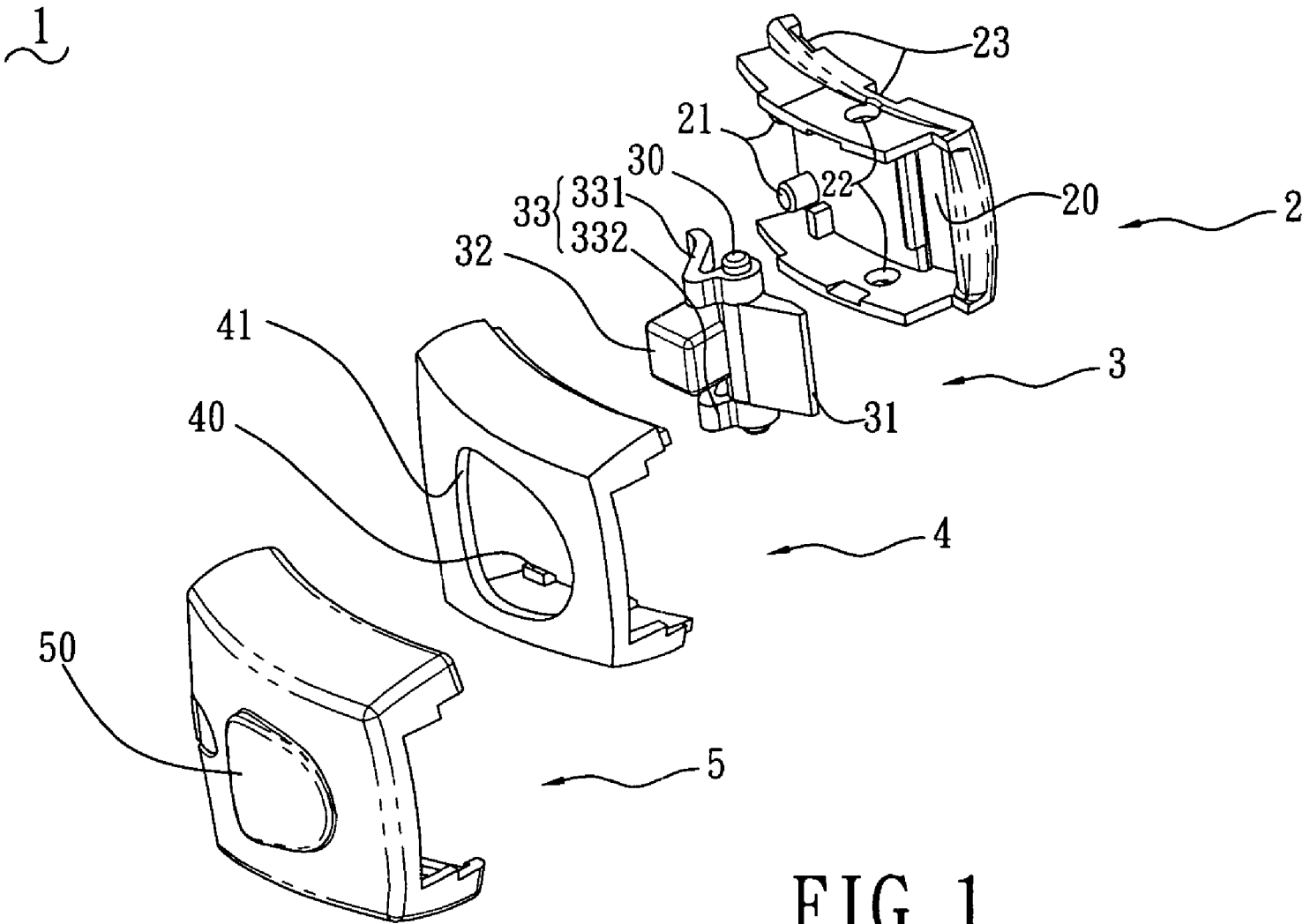
FIG. 1 is an exploded view of a buckle for swimming goggles according to the first embodiment of the present invention.
Figure 4:
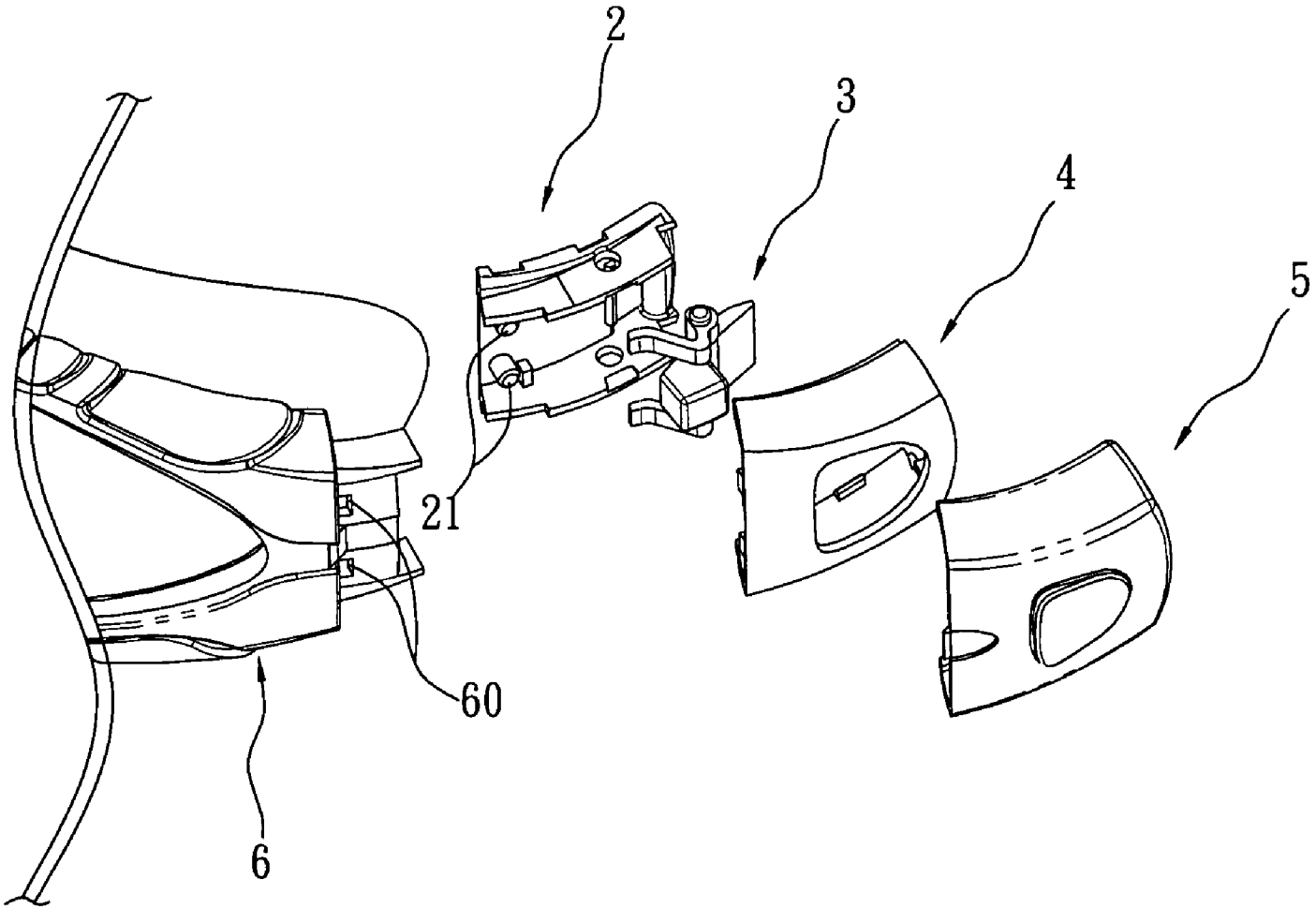
FIG. 4 is an exploded view of the buckle and a left/right frame of the swimming goggles.

FIG. 1 shows a buckle 1 for swimming goggles according to a first embodiment of the present invention. With reference to FIG. 1, a buckle 1 for swimming goggles comprises a connecting base 2, a pressing member 3, a cover 4 and a wrapping layer 5. The connecting base 2 defines a slot 20 for allowing a head strap (not shown) movable therethrough, and shaft holes 22 and locking grooves 23 at both sides thereof. A mounting element 21 is formed between the connecting base 2 and the cover 4 for mounting on a left/right frame 6 (shown in FIG. 4) of the swimming goggles. In the first embodiment, the mounting element 21 includes positioning posts integrated with the connecting base 2 for assembling to prescribed assembling holes 60 of the left/right frame 6, as shown in FIG. 4.

The pressing member 3 pivots to the connecting base 2 by means of leverage, and forms pivotable connection with the left/right frame 6 complying with leverage principle. The pressing member 3 has a biasing wall 31 integrally formed on an end thereof, and a free end (not labeled) opposite to the biasing wall 31. The biasing wall 31 abuts against stopping grooves of the head strap. The pressing member 3 includes a connecting shaft 30 for assembling on the shaft holes 22 when assembled. A button 32 and a resilient portion 33 are integrally formed on the free end of the pressing member 3 and opposite to the biasing wall 31. The button 32 controls the pressing member 3 to disengage from the stopping grooves of the head strap. In this embodiment, the button 32 is arranged near a center of the connecting shaft 30 for manual operation. The biasing wall 31 moves reversely along an arcuate course when the button 32 is pressed. The resilient portion 33 provides returning force for the pressing member 3 thereby retaining the button 32 movable even when assembled. In this embodiment, the resilient portion 33 includes a pair of curved pegs 331,332 on opposing ends of the connecting shaft 30. In another embodiment, the button 32 is integrally formed on the cover 4 and corresponds to the free end of the pressing member 3 in assembly. As an example, the cover 4 defines a through hole 41 therein, and the button 32 is formed on an inner wall of the through hole 41. The resilient portion 33 is a compressible spring formed in a movement course of the free end of the pressing member 3.

The cover 4 is assembled to the connecting base 2, and forms latching poles 40 for corresponding to the locking grooves 23. A through hole 41 is defined in the cover 4, a part of the button 32 extending beyond the cover 4.

The wrapping layer 5 is integrally formed on an outward side of the cover 4, and envelopes the button 32 entirely. A rib 50 is formed on the wrapping layer 5 and corresponds to the through hole 41 of the cover 4, thereby overlaying the button 32 for facilitating identification of the button's location and the button is operated by the user depressing the rib 50. In other embodiments, the wrapping layer 5 is separately formed and locks with the cover 4.

Figure 2:
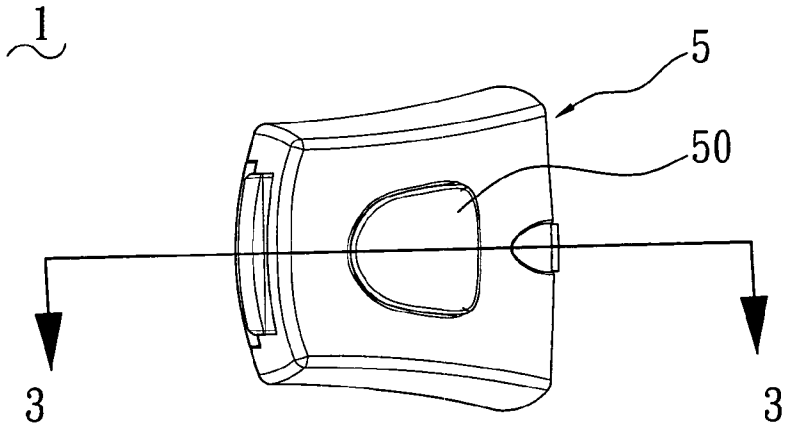
FIG. 2 is an assembled view of the buckle of FIG. 1.
Figure 3:
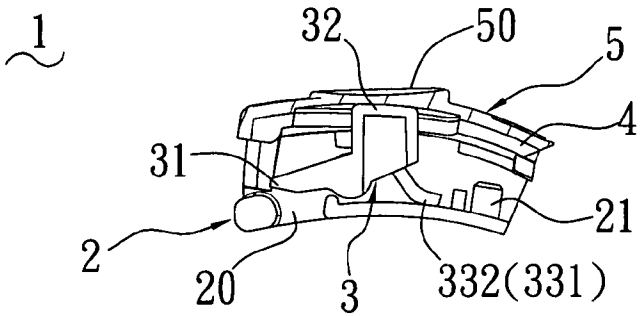
FIG. 3 is a cross sectional view taken along the line 3-3 in FIG. 2.

FIGS. 2 and 3 show the assembled buckle 1. As seen in FIG. 3, the button 32 is fully shrouded by the wrapping layer 5. The exterior of the buckle 1 is smooth without any exposed apertures, thereby avoiding nipping users' hair. The rib 50 facilitates identification of the location of the button 32 and the user is then able to operate the button by depressing the rib 50 of the wrapping layer 5. Further referring to FIG. 4, the buckle 1 is assembled on a left/right frame 6 of the swimming goggles. An assembling hole 60 is defined in the left/right frame 6 for engaging with the mounting element 21 of the connecting base 2. The cover 4 and the connecting base 2 are assembled firmly on the left/right frame 6.

Figure 5:
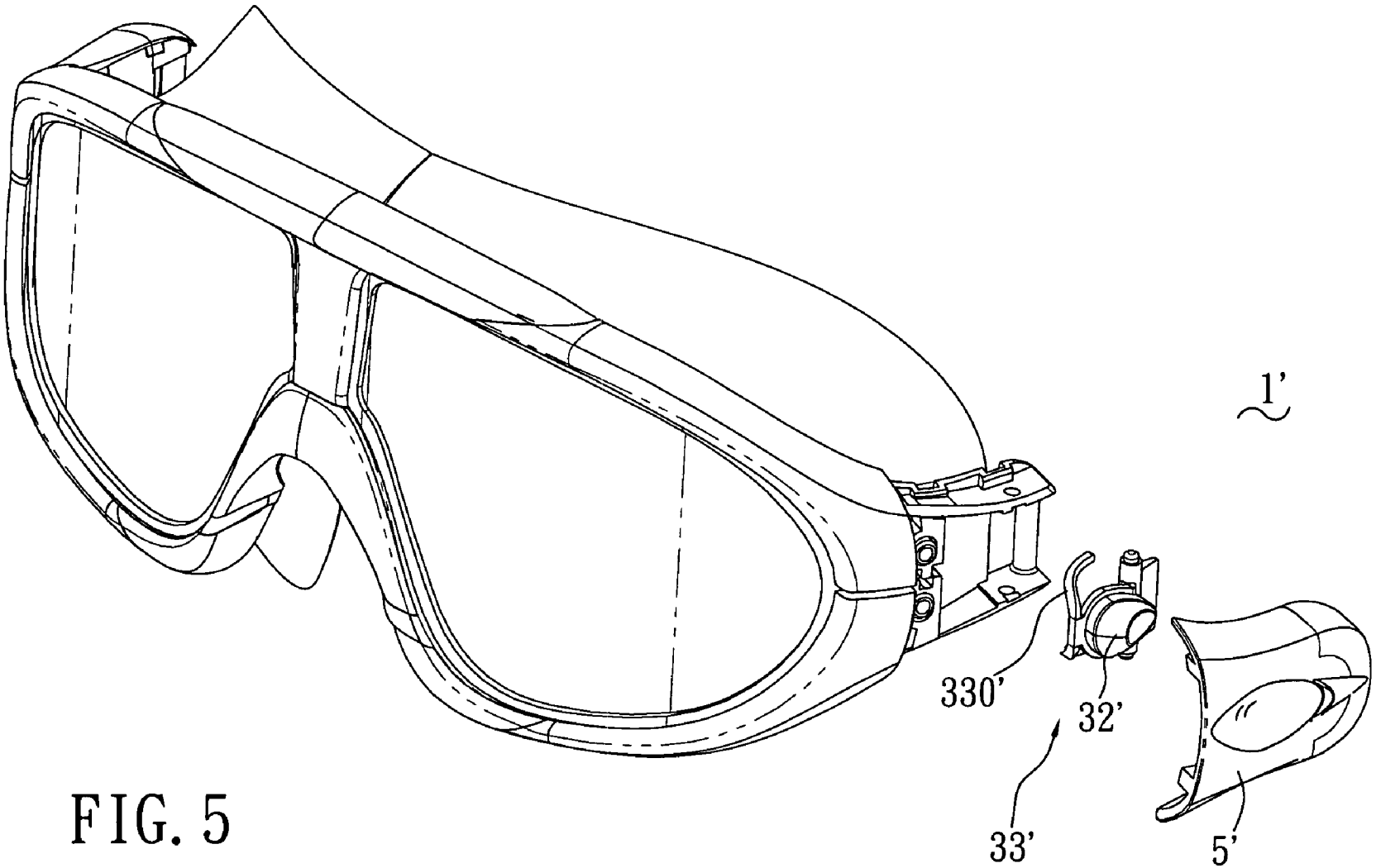
FIG. 5 is a perspective view of the buckle and the swimming goggles according to the second embodiment of the present invention, wherein a portion of the buckle is disassembled.
Figure 6:
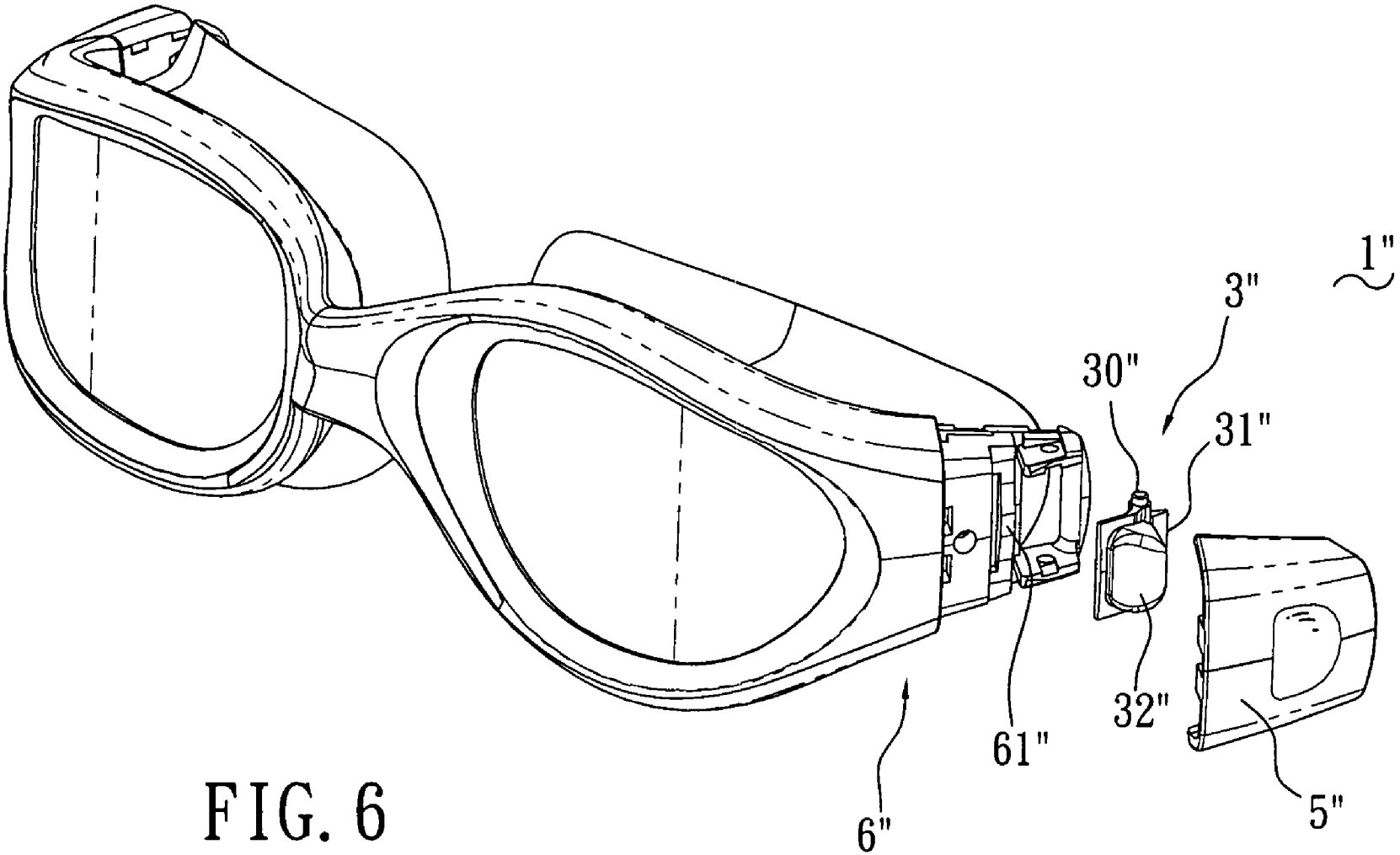
FIG. 6 is a perspective view of the buckle and the swimming goggles according to the third embodiment of the present invention, wherein a portion of the buckle is disassembled.

FIGS. 5 and 6 respectively show a second embodiment and a third embodiment of the present invention. Referring to FIG. 5, the buckle 1' of the second embodiment is similar to the buckle 1 of the first embodiment except that a resilient portion 33' has a curved peg 330' alone. Referring to FIG. 6, the buckle 1" of the third embodiment is similar to the buckle 1 of the first embodiment as well. A pressing member 3" of the buckle 1" is a planar plate, and forms a connecting shaft 30" on a middle portion thereof. A biasing wall 31" is formed on a side of the connecting shaft 30", and a button 32" is formed on another side of the connecting shaft 30" opposite to the biasing wall 31". A left/right frame 6" forms an arcuate portion 61" on a side thereof and serves as the resilient portion 33 of the buckle 1 in the first embodiment. In other embodiments, the arcuate portion 61" may be tongue-like, or the resilient portion 33 is a compressible spring separately. Differences of these embodiments mainly lie in ways for providing returning force for the pressing member. A wrapping layer 5' of the second embodiment and a wrapping layer 5" of the third embodiment are identical to the wrapping layer 5 of the first embodiment. In the second embodiment, the wrapping layer 5' envelops a button 32'. In the third embodiment, the wrapping layer 5" envelops a button 32". Similarly, the buckle 1',1" also have smooth surface without apertures, thereby avoiding nipping users' hair.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A buckle for swimming goggles adapted for assembling on a left/right frame, allowing a head strap to be pulled therethrough and controlling engagement with or disengagement from stopping grooves of the head strap, comprising:

a connecting base defining a slot for allowing the head strap to be movable therethrough;

a pressing member pivoting to the connecting base by means of leverage, and having a biasing wall integrally formed on an end thereof for abutting against stopping grooves of the head strap, and a free end opposite to the biasing wall;

a button being displaceable for controlling the pressing member to disengage from the stopping grooves of the head strap, the button being integrally formed on the free end of the pressing member;

a cover assembled to the connecting base, the cover having a through hole formed therein, a part of the button extending beyond the cover and passing through the through hole;

a wrapping layer provided on an outward side of the cover, entirely overlaying the through hole in the cover and enveloping the part of the button passing through the through hole, the wrapping layer providing a smooth outer surface for preventing a user's hair from being caught in the buckle and the wrapping layer being depressible to displace the button; and a mounting element formed between the connecting base and the cover for mounting on the left/right frame of the swimming goggles.

2. The buckle for swimming goggles as claimed in claim 1, wherein a rib is formed on the wrapping layer in correspondence with the through hole of the cover and overlaying the part of the button passing through the through hole for facilitating identification of the button's location, the button being operated by pressing the rib.

3. The buckle for swimming goggles as claimed in claim 1, further comprising a resilient portion to provide returning force for the pressing member.

4. The buckle for swimming goggles as claimed in claim 3, wherein the pressing member forms a connecting shaft for engaging with the connecting base.

5. The buckle for swimming goggles as claimed in claim 4, wherein the resilient portion includes a pair of curved pegs on opposing ends of the connecting shaft for retaining the button movable when assembled.

6. The buckle for swimming goggles as claimed in claim 1, wherein the wrapping layer is integrally formed with the cover, or the wrapping layer is separately formed and is located with the cover.

7. The buckle for swimming goggles as claimed in claim 1, wherein the connecting base defines locking grooves at both sides thereof, and the cover forms latching poles for corresponding to the locking groove.

8. The buckle for swimming goggles as claimed in claim 1, wherein the mounting element includes positioning posts on the connecting base for assembling to assembling holes of the left/right frame.

9. The buckle for swimming goggles as claimed in claim 1, wherein the cover defines a through hole therein, and the button is formed on an inner wall of the through hole.

10. The buckle for swimming goggles as claimed in claim 9, further comprising a resilient portion to provide returning force for the pressing member.

11. The buckle for swimming goggles as claimed in claim 10, wherein the resilient portion is a compressible spring disposed in the course of the free end of the pressing member.

* * * * *